US007409938B2

(12) United States Patent
Dengler

(10) Patent No.: US 7,409,938 B2
(45) Date of Patent: Aug. 12, 2008

(54) VALVE DRIVE OF AN INTERNAL COMBUSTION ENGINE COMPRISING A CYLINDER HEAD

(75) Inventor: Stefan Dengler, Ingolstadt (DE)

(73) Assignee: Audi AG, Ingolstadt (DE)

( * ) Notice: Subject to any disclaimer, the term of this patent is extended or adjusted under 35 U.S.C. 154(b) by 172 days.

(21) Appl. No.: 10/549,612

(22) PCT Filed: Mar. 17, 2004

(86) PCT No.: PCT/EP2004/002758

§ 371 (c)(1),
(2), (4) Date: Feb. 15, 2006

(87) PCT Pub. No.: WO2004/083611

PCT Pub. Date: Sep. 30, 2004

(65) Prior Publication Data

US 2007/0034184 A1 Feb. 15, 2007

(30) Foreign Application Priority Data

Mar. 21, 2003 (DE) ..... 103 12 581
Mar. 21, 2003 (DE) ..... 103 12 582

(51) Int. Cl.
*F01L 1/47* (2006.01)

(52) U.S. Cl. ..... 123/90.18; 123/90.15

(58) Field of Classification Search ..... 123/90.18, 123/90.15, 90.16, 90.17
See application file for complete search history.

(56) References Cited

U.S. PATENT DOCUMENTS 5,289,806 A * 3/1994 Hurr ..... 123/90.17
5,359,970 A * 11/1994 Krebs ..... 123/90.17
6,425,359 B2 * 7/2002 Fujii et al. ..... 123/90.18
6,427,653 B1 * 8/2002 Hara et al. ..... 123/90.17
6,474,281 B1 * 11/2002 Walters ..... 123/90.18
6,481,401 B1 * 11/2002 Schafer ..... 123/90.17
6,666,197 B2 * 12/2003 Bayer ..... 123/672
2001/0017114 A1 * 8/2001 Mikame ..... 123/90.15
2002/0017258 A1 * 2/2002 Moriya et al. ..... 123/90.18
2003/0192496 A1 * 10/2003 Walters ..... 123/90.18

FOREIGN PATENT DOCUMENTS

DE 199 08 286 A 8/2000
EP 0 798 451 A 10/1997

* cited by examiner

*Primary Examiner*—Stephen K. Cronin
*Assistant Examiner*—Jason Benton
(74) *Attorney, Agent, or Firm*—Novak Druce + Quigg LLP

(57) ABSTRACT

The invention relates to a valve drive of an internal combustion engine, comprising at least one camshaft whereon at least one cam carrier is arranged in a rotationally fixed and axially displaceable manner. Means for applying axial tension are formed between the at least one camshaft and the at least one cam support, thereby enabling the at least one cam support to be fixed in an axial manner.

10 Claims, 5 Drawing Sheets

VALVE DRIVE OF AN INTERNAL COMBUSTION ENGINE COMPRISING A CYLINDER HEAD

This application is a § 371 application of PCT/EP2004/002758, which claims priority from DE 10312581.7, filed Mar. 21, 2003, and DE 10312582.5, filed Mar. 21, 2003.

BACKGROUND

This invention relates to a valve drive of an internal combustion engine comprising a cylinder head.

Mechanical devices designed to improve the thermodynamic properties of internal combustion engines have been disclosed, devices which affect the operating cycle of the valve drive and, for example, affect the timing of the valve drive and, for example, enable speed-dependent variation of the opening times or the lift of charge-cycle valves.

SUMMARY OF THE INVENTION

Publication DE 42 30 877 discloses such a device, one in which a cam carrier is mounted on a base camshaft so as to be nonrotatable and axially displaceable. The cam carrier consists of a tubular material on which at least one cam is mounted, such that a plurality of cam paths proceeds axially displaced from a common base circle. A charge-cycle valve may be actuated by the axial displacement of the cam piece on the base camshaft by the variously configured cam paths, the cam paths differing in lift and/or phase relationship.

One advantageous device for axial displacement of a cam carrier has been disclosed in publication EP 0 798 45 1, a device in which a worm gear drive is configured on both sides of the cam carrier and has as recess a curved path into which a final control element may be introduced for axial displacement of the cam carrier.

In order for a cam carrier to remain on the base camshaft in the position in which it had been displaced by fitting of the final control element into the worm gear drive, a detent device is provided which consists of detent means mounted in the base camshaft and fitted into detent grooves made in the cam carrier. Three detent grooves corresponding to the three cam paths are configured on one cam.

The essential disadvantage of this camshaft-centered configuration of the detent device is that the base camshafts and the cylinder head are often made of different materials having different thermal expansion coefficients. As a result, the camshaft-centered detent device will not lock with precision either in an unwarmed internal combustion engine or one warmed-up for operation. This effect may be intensified by inaccuracies in manufacture and assembly or ones determined by operation to the extent that reliable operation of the internal combustion engine is not possible.

A cylinder-head-centered detent device for a base camshaft with axially displaceable cam carriers has been disclosed in publication DE 101 48 243, mounting of the base camshaft in the cylinder head of the internal combustion engine being effected by means of at least one camshaft bearing including the cam carrier.

The detent device consists of detent means mounted in the camshaft bearing and fitted into detent grooves made in the cam carrier. In a cam carrier with two cams each having two cam paths, there must be two axially adjacent detent grooves in which the detent means is engaged.

The essential disadvantage of this cylinder-head-centered detent device is represented by the extensive wear occurring in the camshaft bearing, since an appreciable portion of the sliding surfaces is employed for the detent grooves. In addition, the base camshaft and the cam carrier are displaced to one side of the camshaft bearing by the detent means. This detent device also requires a good supply of lubricant, something which cannot be guaranteed over the precision-fitted and often polished gliding surfaces of the bearings.

The object of the invention is to create a valve drive in which the cam carrier is reliably held in its position after displacement, irrespective of thermal effects.

In one embodiment of the invention a first axial position of the cam carrier is defined in that a first contact surface rigidly mounted on a cam carrier is in contact with a first contact surface rigidly mounted on a cylinder head.

A second axial position of the cam carrier is accordingly defined in that a second contact surface rigidly mounted on a cam carrier is in contact with a second contact surface rigidly mounted on a cylinder head.

Provision is made such that means are configured for application of an axial tensioning force between the base camshaft and at least one cam carrier. This tensioning force is oriented so that the cam carrier when in the first axial position is also displaced in the direction of this first axial position. Similarly, the cam carrier in the second axial position is also displaced in the direction of this second axial position. This tensioning force exerts its effect independently of thermally determined expansion effects of the valve drive.

Provision is made such that the first axial contact surface rigidly mounted on a cam carrier and the second contact surface rigidly mounted on a cam carrier are side surfaces of the carrier of at least one cam.

The first contact surface rigidly mounted on a cylinder head and the second contact surface rigidly mounted on a cylinder head are side surfaces of the camshaft bearing comprising the cam carrier.

In one advantageous development of the invention provision is made such that the means for application of an axial tensioning force from the base camshaft to the cam carrier is configured as a detent device.

The detent device has detent means mounted in the camshaft and movable in the radial direction, the detent means being pressed by a force directed radially preferably against the interior surface of the cam carrier. At least two circumferential detent grooves spaced an axial distance from each other are configured on the inside of the cam carrier, the detent grooves being configured to be approximately v-shaped in the cam carrier, so that the two sides of the detent groove form a ramp for the detent means. The detent grooves conceivably might also be configured in the base camshaft, in which case the detent device would be configured in the cam carrier.

In another advantageous development of the invention provision is made such that the radially oriented force is the restoring force of a spring element.

Provision is made in another advantageous development of the invention such that the detent means is a detent bolt, the side of the detent facing the detent grooves being rounded.

In an alternative advantageous development of the invention provision is made such that the detent means is a detent ball.

In a last advantageous development of the invention provision is made such that a cam carrier is mounted on the at least one base camshaft for each cylinder of the internal combustion engine.

BRIEF DESCRIPTION OF THE DRAWINGS

The valve drive of an internal combustion engine claimed for the invention is described in what follows on the basis of an exemplary embodiment with reference to seven figures, of which

DETAILED DESCRIPTION OF THE INVENTION

Figure 1:
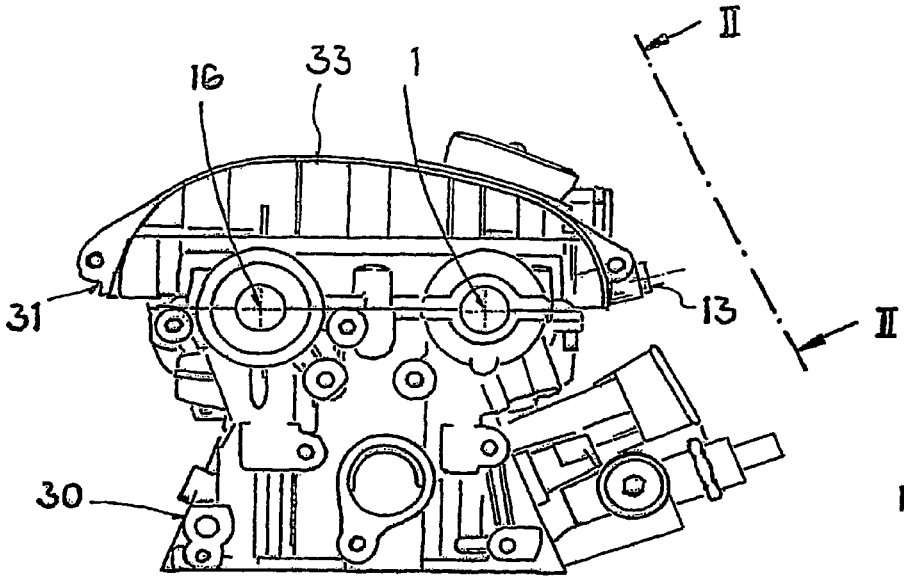
FIG. 1 presents a side view of a four-cylinder internal combustion engine as claimed for the invention.
Figure 2:
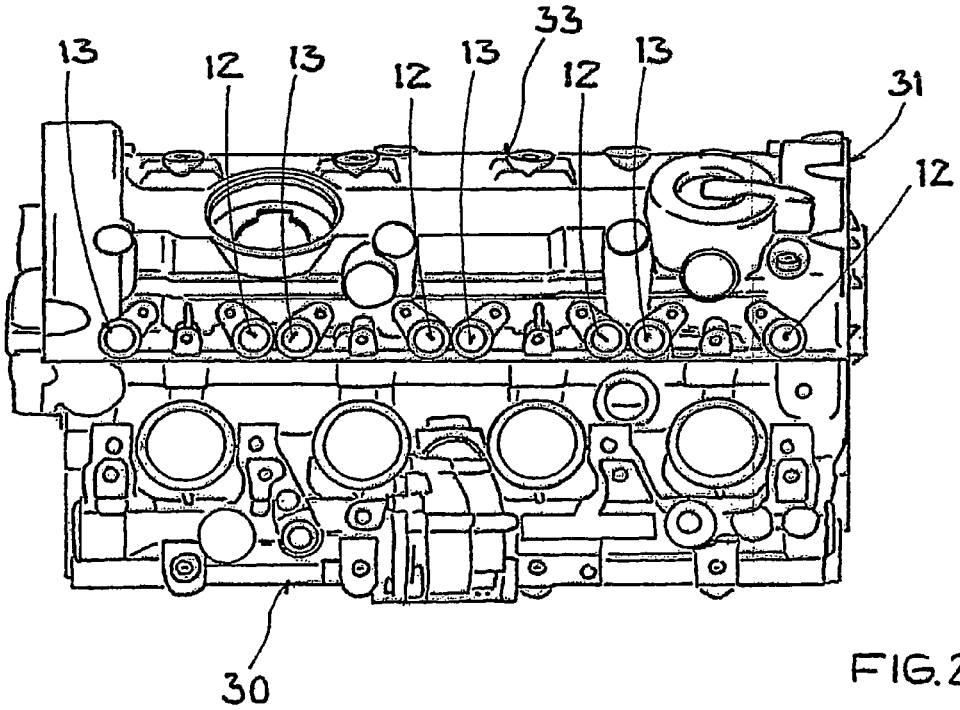
FIG. 2 a view of the internal combustion engine shown in FIG. 1 along line II-II.
Figure 3:
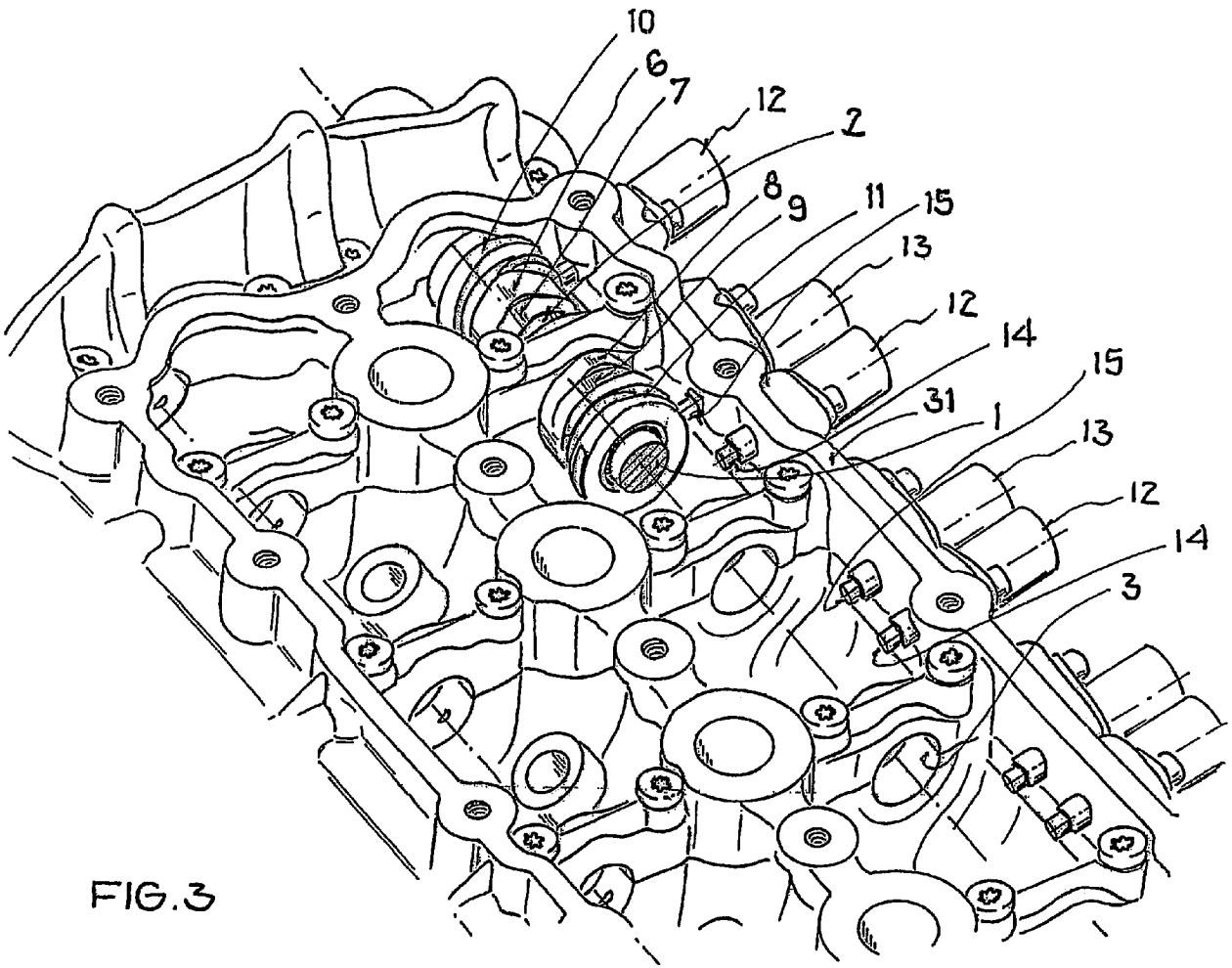
FIG. 3 a perspective view of the camshafts installed in the internal combustion engine shown in FIGS. 1 and 2, with the cylinder head cover removed.

FIGS. 1 to 3 illustrate an example of an external-ignition four-cylinder in-line internal combustion engine having a crankcase 30 with a cylinder head 31 and cylinder head cover 33 of conventional design. Two intake and two outlet valves (not shown) are installed per cylinder, the intake valves being operated by an intake-valve camshaft and the outlet valves by an outlet-valve camshaft 16 controlled by conventional means. For this purpose the intake camshafts and the outlet camshafts 16 are mounted so as to be in parallel with the longitudinal axis of the engine and are mounted on the two sides of the row of cylinders in the cylinder head 31 so as to be rotatable.

The outlet camshaft 16 and the intake camshaft, which consists of a base camshaft 1 and four cam carriers 2, are driven by conventional means not shown.

Figure 4:
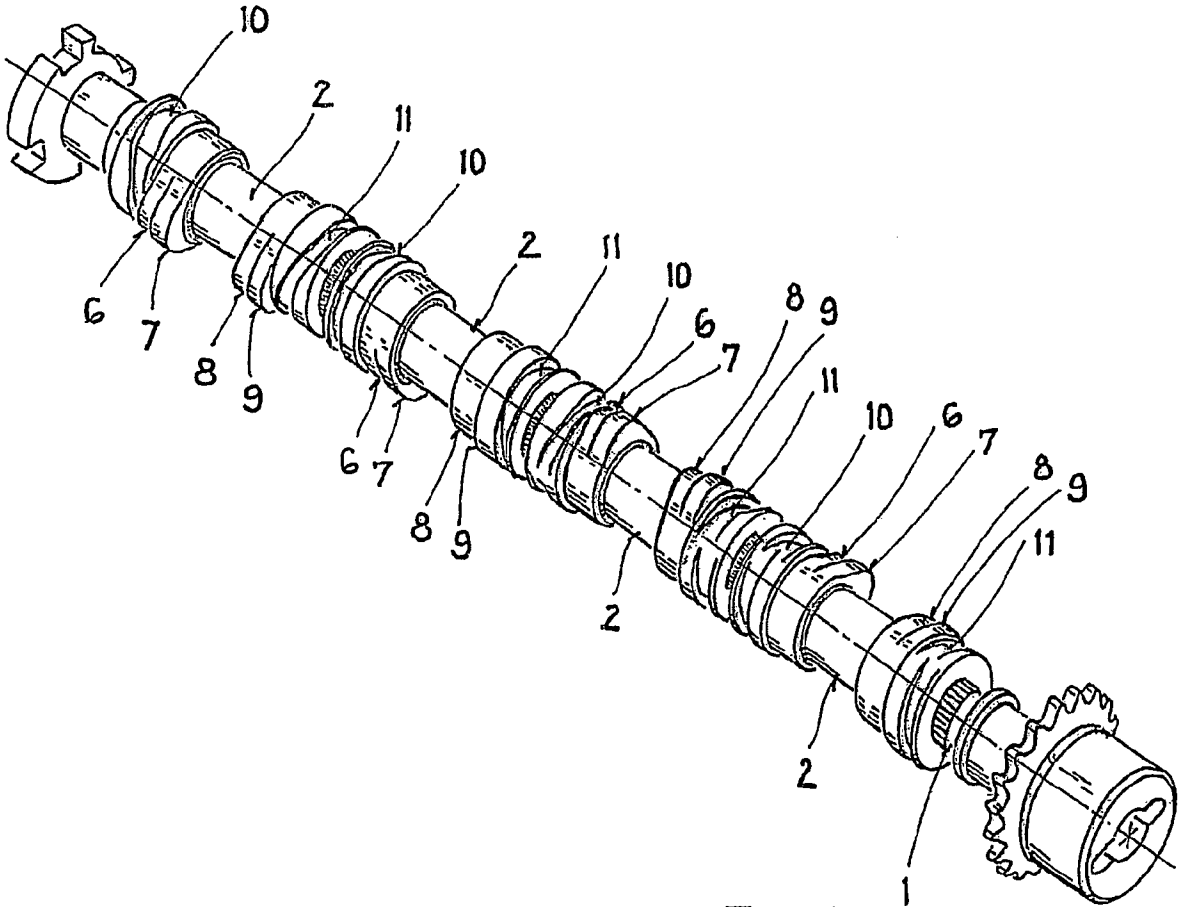
FIG. 4 a view of one of the two camshafts, disassembled.

FIG. 4 shows the intake camshaft, on the base camshaft 1 of which the four cam carriers 2 configured as hollow shafts are mounted spaced axially at a distance from each other. The cam pieces 2 are mounted on the base camshaft 1 so as to be axially displaceable but non-rotatable. As is shown in FIGS. 3, 4, 5, 6, and 7, a worm-wheel drive with an axial curve 10 or 11 configured as a recess which winds spirally around the cam carrier axis is mounted on both ends of each cam carrier 2.

Two cams are mounted on each cam carrier 2, two different cam paths 6, 7 and 8, 9, axially displaced, proceeding from the same basic circle for each cam. The cylindrical area of the covering surface of each cam piece 2 located between the two cams is designed as bearing surface for a camshaft bearing 3.

As is shown in FIGS. 3, 5, 6, and 7, each cam carrier 2 with this cylindrical bearing surface is mounted in a camshaft bearing block 3 of the cylinder head 31 so as to be rotatable and axially displaceable.

The two front surfaces of the cams facing the camshaft bearing block 3 are configured as bearing surfaces 18 and 19. The front surfaces of the camshaft bearing block 3 facing the cams are correspondingly configured as bearing surfaces 17 and 20. The spacing between the two bearing surfaces 17 and 18 of the cams is greater than the spacing of the bearing surfaces 19 and 20 of the camshaft bearing block 3.

The maximum distance which may separate the bearing surfaces 17, 19 from the bearing surfaces 18, 20 corresponds to the width of the cam paths 6, 7, 8, 9 and to the distance to which a cam carrier may be displaced by the axial curves 10 and 11 of the worm drives.

The charge-cycle valves 27, 28 of the internal combustion engine are actuated by the cams by way of drag levers 21, which are configured with a roller 23 in order to reduce friction.

A play equalization element 25, 26 mounted in the cylinder head is conventionally associated with the drag levers 21, 22.

Figure 6:
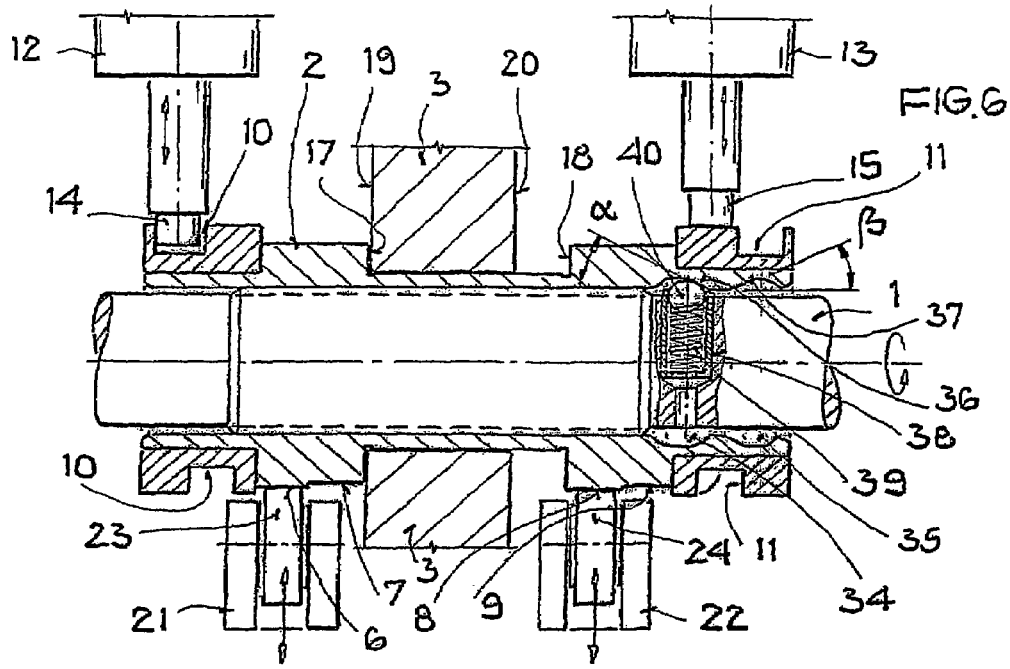
FIG. 6 a section of the cam carrier shown in FIG. 5, in the first valve lift control position.
Figure 7:
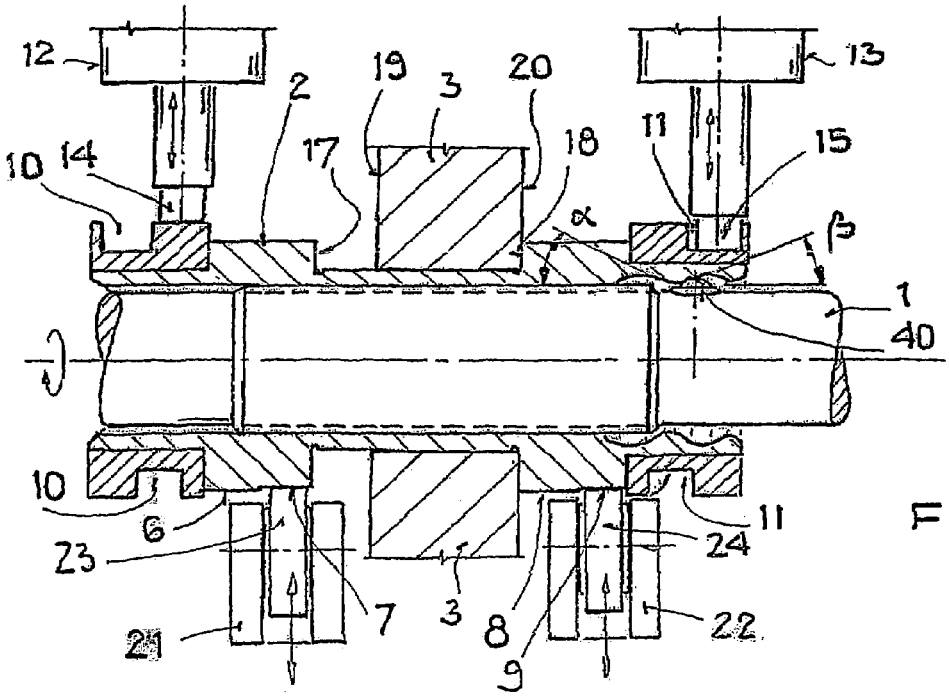
FIG. 7 a section of the cam carrier shown in FIG. 5, in the second valve lift control position.

As is shown in FIGS. 6 and 7, the interior of the cam carriers 2 has two mutually parallel axially spaced detent grooves 34, 35 extending over the entire interior circumference of the cam carrier. The detent grooves are in approximation v-shaped, the edges of the v-shaped detent groove being rounded.

The two detent grooves 34, 35 are designed with groove walls extending diagonally from radially outward to radially inward which form tapered surfaces 36, 37, the tapered surface 36 forming with the groove 34 an angle of inclination $\alpha$ to the axis of rotation of the camshaft 1 and the surface 37 forming with the groove 35 an angle of inclination $\beta$ to the axis of rotation of the camshaft 1.

Figure 5:
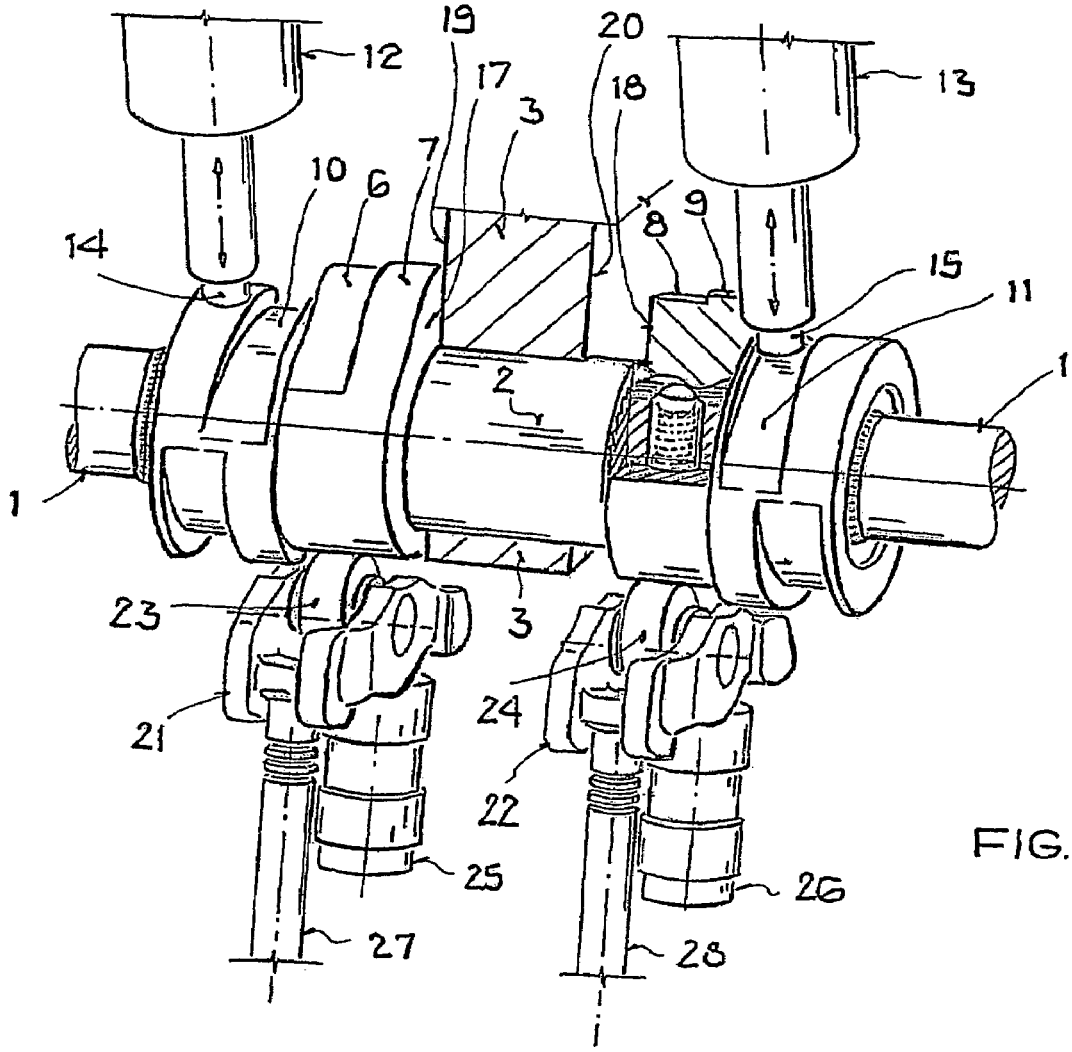
FIG. 5 a section of the camshaft shown in FIG. 3 with a cam carrier enclosed in a bearing block.

As seen in FIGS. 5, 6, and 7, a stop ball 40 of conventional design is mounted so as to be movable in a radial pocket bore 38. The stop ball 40 is pretensioned by a spiral pressure spring 39 one end of which rests on the bottom of the pocket bore 38 configured as opposing bearing and the other end of which rests on the ball 40, in such a way that the stop ball 40 is pretensioned to press against the radially interior surface of the cam carrier 2.

The distance between the tapered surfaces 36 and 37 and the two grooves 35 and 36 and the axial position of the pocket bore 38 are coordinated so that, when the bearing surface 18 of the cam 8 rests on the bearing surface 20 of the bearing block 3, the stop ball 40 is in contact with the tapered surface 37 (as illustrated in FIG. 7) and, when the bearing surface 19 of the cam 7 is in contact with the bearing surface 17 of cam bearing block 3, the stop ball 40 is in contact with the tapered surface 36 of the groove 34 (as illustrated in FIG. 5 and FIG. 6).

Thus, when the cam carrier 2 is in the position illustrated in FIGS. 5 and 6, in which the bearing surface 19 of the cam 7 is in contact with the bearing surface 17 of the bearing block 3, there is introduced into the cam carrier 2, by way of the stop ball 40 and the tapered surface 36 of the circumferential groove 34, an axial force from the camshaft 1 into the cam carrier 2 which is oriented in the direction opposite that of the axial force acting from the bearing block 3 by way of the bearing 17 on the bearing 19 of the cam 9. Thus, the cam carrier 2 is fixed in position for both axial directions.

When the cam carrier 2 is in the position illustrated in FIG. 7, in which the bearing surface 18 of the cam 8 is in contact with the bearing surface 20 of the bearing block 3, the stop ball 40 is in contact with the tapered surface 37 of the second circumferential groove 35, as a result of which an axial force is introduced by the camshaft 1 into the cam carrier 2, a force the direction of action of which is opposite the direction of action of the axial force acting from the bearing surface 20 of the bearing block 3 by way of the bearing surface 18 of the cam 8. In this operating position as well the cam carrier 2 is fixed in position in both directions.

Varying extension of the base camshaft in relation to the cylinder head effects only slight displacement of the point of contact of ball 40 and the tapered surface 36 (first position as illustrated in FIG. 6) or the tapered surface 37 (second position as illustrated in FIG. 7). In addition, the axial force required is introduced by the ball 40 as a function of the inclination $\alpha$ or $\beta$ of the tapered surfaces 36, 37.

Displacement of the lift valve control from the operating state illustrated in FIGS. 5 and 6 to the operating state illustrated in FIG. 7 is effected in that, as illustrated in FIG. 6, the carrier pin 14 of an electric actuator mounted in the cylinder head 31 and associated with the axial curve 10 is engaged in the axial curve 10 configured as a recess. As a result of rotation of the camshaft 1 and the cam carrier 2, contact between the carrier pin 14 and the groove walls of the axial curve 10 causes the cam carrier 2 to be displaced axially to the left until the ball 40 pretensioned by the spring 39 rolls into the groove 35 of the cam carrier 2.

As the ball 40 rolls over the tapered surface 37 as the cam carrier 2 undergoes further axial displacement, the bearing surface 18 of the cam 8 moves toward the bearing surface 20 of the bearing block 3 and comes into axial contact with it. The ball 40 remains in axial contact with the bearing surface 37. The cam carrier 2 is fixed in axial position. The carrier pin 14 is again removed by conventional means by the electric actuator 12 from the axial curve 10 configured as a circumferential groove.

The carrier pin 15 of one of the electric actuators 13 associated with the axial curve 11 and mounted in the cylinder head 31 is introduced by the actuator into the axial curve 11 configured as a recess in order to displace the lift valve control from the operating state illustrated in FIG. 7 to the operating state illustrated in FIG. 5 and FIG. 6. As a result of rotation of the camshaft 1, the cam carrier 2 in FIG. 7 is displaced axially to the right by the contact between the groove walls of the axial curve 11 and the carrier pin 15, so that the stop ball 40 first rolls out of the groove 35 along the outline of the tapered surface 37 against the force of the spring 39, along the outline of the tapered surface 36, until the ball 40 is forced by the restoring force of the spring 39 into the groove 34 and the bearing surface 17 of the cam 7 comes into contact with the bearing surface 19 of the bearing block 3. Contact is maintained between carrier ball 40 and tapered surface 36. The cam carrier 2 is fixed in position axially in both directions by the contact between bearing surface 17 of the cam 7 and the bearing surface 19 of the bearing block 3 on one side and by the contact between cone 36 and stop ball 40 on the other side. The carrier pin 15 is removed by a conventional method from the circumferential groove of the axial curve 11 by means of the electric actuator 13.

Operation of the electric actuators is controlled by conventional means (not shown) by the engine control equipment (not shown).

The values of angles $\alpha$ and $\beta$ are determined on the basis of individual requirements, so that the axial force of fixing in the operating positions is ensured for the lift valve control and so that removal of the detent connection after engagement of the carrier pins 14 and 15 in the circumferential grooves 10 and 11 when rotation of the camshaft 1 in the direction of its operation is made certain. For example, the values selected for angles $\alpha$ and $\beta$, between 15° and 45°, are the same, 30° for example.

Even if each of the tapered surfaces 36 and 37 has a constant angle of inclination $\alpha$ and $\beta$ over its axial extent in the exemplary embodiments illustrated, it is also conceivable, if a dynamic axial force process is practical, that the inclination of one or both tapered surfaces 36 and 37 could be configured to have a constantly variable angle of inclination $\alpha$ or $\beta$ in the axial direction.

The four cam carriers 2 of the camshaft 1 illustrated in FIGS. 3 and 4 may thus be displaced individually by the associated actuators 12 and 13 between their two operating positions for the purpose of lift valve control.

A configuration such as this of displacement of the lift valve control is possible both for an intake camshaft controlling intake valves only and for an outlet camshaft 16 controlling outlet valves only. It is also possible to provide a configuration such as this on a camshaft which controls both intake valves and outlet valves.

In an internal combustion engine which has two camshafts 1 and 16 as illustrated in FIGS. 1 to 3, one of which is designed exclusively to control the intake valves and the other exclusively to control the outlet valves, the displacement of the lift valve control may be designed to take place only on one of the two camshafts or on both camshafts.

A configuration such as this of controlled displacement of the lift valve control is also possible on internal combustion engines with a larger or smaller number of cylinders than the four cylinders indicated in the exemplary embodiment. A configuration such as this of controlled displacement of the lift valve control is also possible with different cylinder configurations of engines, such as in engines with cylinders in line, V engines, or VR or W engines. Lift valve control displacement is possible both on spark-ignition and on spontaneous-ignition internal combustion engines.

The invention claimed is:

1. A valve drive of an internal combustion engine comprising:

a cylinder head with at least one camshaft on which at least one cam carrier is mounted so as to be nonrotatable and axially displaceable, the at least one cam carrier having at least one cam on which at least two different cam travel paths are configured, the at least one cam carrier, for the purpose of bearing the at least one camshaft, being enclosed in at least one camshaft bearing rigidly mounted on a cylinder head, means for axially displacing at least one cam carrier in relation to the at least one camshaft between a first axial position and at least one second axial position, wherein in the first axial position of the cam carrier, a first contact surface rigidly mounted on a first cam carrier is in contact with a first contact surface rigidly mounted on a cylinder head, in the second axial position of the cam carrier, a second contact surface rigidly mounted on a cam carrier is in contact with a second contact surface rigidly mounted on a cylinder head, and means for applying an axial tensioning force are configured between camshaft and cam carrier, the axial tensioning force displacing the cam carrier in the area of the first axial position in the direction of the first axial position, and in the area of the second axial position in the direction of the second axial position.

2. The valve drive as claimed in claim 1, wherein the first axial contact surface rigidly mounted on a cam carrier and the second contact surface rigidly mounted on a cam carrier are side surfaces of the at least one cam.

3. The valve drive as claimed in claim 1, wherein the first contact surface rigidly mounted on a cylinder head and the second contact surface rigidly mounted on a cylinder head are side surfaces of at least one camshaft bearing.

4. The valve drive as claimed in claim 1, wherein the means for application of an axial tensioning force from the base camshaft to the cam carrier is configured as a detent device.

5. The valve drive as claimed in claim 4, wherein the detent device has a detent means mounted in the camshaft and movable in the radial direction, the detent means being pressed radially outward by a force against the interior surface of the cam carrier, and wherein at least two circumferential and axially spaced detent grooves are configured on the interior surface of the cam carrier, and wherein the detent grooves are designed in the cam carrier to be v-shaped, as a result of which the two sides of the detent groove form a ramp for the detent means.

6. The valve drive as claimed in claim 5, wherein the radially oriented force is the restoring force of a spring element.

7. The valve drive as claimed in claim 5, wherein the detent means is a stop bolt, and wherein the sides of the stop bolt facing the detent grooves are rounded.

8. The valve drive as claimed in claim 5, wherein the detent means is a stop ball.

9. The valve drive as claimed in claim 1, wherein on the at least one base cam shaft a cam carrier is mounted for each cylinder of the internal combustion engine.

10. A camshaft of an internal combustion chamber provided with a cylinder head, comprising:

a shaft mounted on said cylinder head for rotation about the axis thereof;

at least one cam carrier nonrotatably mounted on said shaft and displaceable axially, including a cylindrical section journaled in said cylinder head and a pair of opposed surfaces engageable with abutment surfaces of said cylinder head to restrict the axial displacement of said cam carrier in first and second axially spaced positions, at least one cam section having at least two different cam surface profiles, and a section provided with a helical groove cooperable with a member selectively insertable in said groove effective to impart axial displacement of said cam carrier between said first and second positions as said shaft is rotated;

means cooperative with said cam carrier effective to impart axial displacement of said carrier member between said first and second position in a direction opposite of the direction of movement imparted by said helical groove; and means mounted on one of said shaft and cam carrier and cooperative with the other thereof for trippably retaining said cam carrier in one of said first and second positions.

* * * * *